US005613280A

United States Patent [19]

Mandl

[11] Patent Number: 5,613,280

[45] Date of Patent: Mar. 25, 1997

[54] APPARATUS FOR MONITORING SLIVER WRAPPING ABOUT A SLIVER GUIDING ROLL

[75] Inventor: Gerhard Mandl, Winterthur, Switzerland

[73] Assignee: Trützschler GmbH & Co. KG, Mönchengladbach, Germany

[21] Appl. No.: 515,009

[22] Filed: Aug. 14, 1995

[30] Foreign Application Priority Data

Aug. 13, 1994 [DE] Germany ..... 44 28 802.6
Jul. 4, 1995 [DE] Germany ..... 195 24 374.9

[51] Int. Cl.[6] ..... D01G 15/62; B65H 54/76; D01H 5/60

[52] U.S. Cl. ..... 19/239; 19/0.26; 57/264

[58] Field of Search ..... 19/0.25, 0.26, 19/239, 262; 57/264

[56] References Cited

U.S. PATENT DOCUMENTS

| | | | |
|---|---|---|---|
| 2,774,114 | 12/1956 | Gonay | 19/0.26 |
| 2,813,309 | 11/1957 | West et al. | 19/0.26 |
| 4,920,736 | 5/1990 | Stahlecker | 139/0.25 |
| 4,999,884 | 3/1991 | Vignon . | |
| 5,381,651 | 1/1995 | Stahlecker . | |

FOREIGN PATENT DOCUMENTS

| | | |
|---|---|---|
| 134480 | 11/1919 | United Kingdom . |
| 716971 | 10/1954 | United Kingdom . |
| 1069713 | 5/1967 | United Kingdom . |
| 2022627 | 12/1979 | United Kingdom . |
| 1580592 | 12/1980 | United Kingdom . |

*Primary Examiner*—Andy Falik
*Attorney, Agent, or Firm*—Spencer & Frank

[57] ABSTRACT

A sliver processing machine includes a plurality of roll pairs between which a running sliver passes. Each roll pair is composed of a driving roll and a pressure roll. A separate pressing device is connected with each pressure roll for urging each pressure roll against its driving roll. Each pressing device has a shiftable element displaced by the pressure roll upon radial displacement of the pressure roll in response to winding of sliver on either the pressure roll or the associated driving roll. A common actuating element is connected to each shiftable element of each pressing device for displacing the common actuating element upon displacement of any one of the shiftable elements. A switching device is connected to the common actuating element. The switching device has an idle state and a signal-generating state. The switching device is placed into the signal-generating state by the common actuating element upon displacement of the common actuating element by any one of the shiftable elements, whereby the switching device generates a signal in response to winding of sliver on any roll of any of the roll pairs.

18 Claims, 7 Drawing Sheets

APPARATUS FOR MONITORING SLIVER WRAPPING ABOUT A SLIVER GUIDING ROLL

CROSS REFERENCE TO RELATED APPLICATION

This application claims the priority of German Application No. P 44 28 802.6 filed Aug. 13, 1994, which is incorporated herein by reference.

BACKGROUND OF THE INVENTION

This invention relates to an apparatus for monitoring the winding of sliver (wrap formation) on a roll of a sliver guiding roll pair in a fiber processing machine, particularly a drawing frame. The apparatus includes a pressure roll and a driving roll as well as a pressing mechanism for pressing the pressure roll against the driving roll. Further, switching means are provided for deenergizing the drive of the driving roll when wrap formation occurs about either roll. There is further provided a device which accommodates the pressing mechanism and the pressure roll and which also serves for lifting the pressure roll off the driving roll.

In a known apparatus of the above-outlined type a pressure-roll holder is mounted by a bolt on a pivotal yoke. For exerting a pressure on the pressure-roll bearing, a pressure piston is provided in a guide bearing in the pressure-roll holder. A pressing lever exerts a pressure on the guide bearing by means of a compression spring situated between the pressing lever and the piston. The piston has an adjustable shifting element which may be immobilized by a setscrew and which is provided with a shifting cam. The shifting element carries an adjustable contact ring which may be immobilized by a setscrew. To the pivotal yoke a guide bar is secured by means of a carrier element made of an insulating material. The guide bar serves for receiving a contact sleeve which is slidably arranged on the guide bar such that the friction between the guide bar and the contact sleeve does not allow the latter to slide by virtue of its own weight. On the contact sleeve a contact cam is provided which is situated between the shifting cam and the contact ring. The contact sleeve and the contact ring are connected to opposite electric poles of an electric control. If sliver begins to be wound on a pressure roll or driving roll, the pressure roll is displaced against the resistance of the piston by the cooperating driving roll so that the piston is shifted upwardly until the switching element contacts the switching sleeve. In this manner, a switching function is initiated, resulting in an immediate stoppage of the operation of the drawing frame. The distance between the switching element and the contact edge corresponds to the switching stroke of the piston. This distance also corresponds to the thickness of the sliver winding on the roll. It is therefore apparent that the distance is chosen to be as small as possible to ensure that the drawing frame is brought to a standstill as rapidly as possible when wrap formation starts. It follows that the switching voltage must not be high to securely avoid arc generation between the switching element and the switching sleeve even in case of very small distances. If, because of an operational reason, the cylindrical working face of the pressure roll has to be re-ground, the diameter of the roll will necessarily be reduced. The pivotal yoke, however, is fixed in the same operational position independently from such a diameter decrease so that the piston, when pressure is exerted against the bearing, automatically executes a follow-up shift one-half the diametrical difference of the re-ground pressure roll. In such a follow-up adjustment the switching sleeve is also automatically adjusted to the same extent by means of the lid-like closure member. In this manner the distance is automatically shifted to the desired value upon each follow-up grinding of the pressure roll. Before the pivotal yoke is lifted off its abutment, the operating person, by means of a handle, releases the pressing lever so that the spring is relaxed. If the friction between the piston and the guide bearing is selected such that the piston, after lifting the pivot yoke, is not moved downwardly by its own weight, then the shifting cam, together with the contact sleeve, again attains its operational position upon re-positioning the pressing lever. If, however, the pressure roll has to be re-ground, resulting in a reduced roll diameter, the shifting cam displaces the contact sleeve downwardly into its operational position upon positioning the pressing lever until the pressure roll lies on the driving roll. In this manner, the distance between the contact cam and the contact ring is maintained in its original magnitude.

The above-outlined conventional apparatus requires substantial technical and constructional outlay for several reasons. For each roll pair a separate monitoring device is provided, that is, for the drawing frame a plurality of monitoring devices are necessary. It is an additional disadvantage that each individual monitoring device requires a substantial structural and installational outlay. It is a further drawback that in each instance a plurality of distances between the switching element and the switching sleeve have to be accurately set in order to prevent electric arcing even in case of very small distances.

SUMMARY OF THE INVENTION

It is an object of the invention to provide an improved apparatus of the above-outlined type from which the discussed disadvantages are eliminated and which, in particular, is simple to construct and install and which makes possible to reliably monitor sliver wrapping in a fiber processing machine, particularly a drawing frame.

This object and others to become apparent as the specification progresses, are accomplished by the invention, according to which, briefly stated, the sliver processing machine includes a plurality of roll pairs between which a running sliver passes. Each roll pair is composed of a driving roll and a pressure roll. A separate pressing device is connected with each pressure roll for urging each pressure roll against its driving roll. Each pressing device has a shiftable element displaced by the pressure roll upon radial displacement of the pressure roll in response to winding of sliver on either the pressure roll or the associated driving roll. A common actuating element is connected to each shiftable element of each pressing device for displacing the common actuating element upon displacement of any one of the shiftable elements. A switching device is connected to the common actuating element. The switching device has an idle state and a signal-generating state. The switching device is placed into the signal-generating state by the common actuating element upon displacement of the common actuating element by any one of the shiftable elements, whereby the switching device generates a signal in response to winding of sliver on any roll of any of the roll pairs.

By virtue of the fact that the pressing device is coupled with a common, displaceable actuating element, a single monitoring device for a plurality of sliver treating roll pairs is provided in a simple manner. According to the invention, the switching device is actuated by one of the individual shiftable elements via the common actuating element, so that each roll pair needs to affect only a single shiftable element, whereby a significant structural and installational simplification is achieved. Therefore it suffices to use a single switching device to respond to displacements of the common actuating element which too, result in advantages as far structure and installation are concerned. Also, the monitoring device according to the invention is significantly simpler than any known individual monitoring device.

The invention has the following additional advantageous features:

The switching device has a predetermined switching path which remains constant independently from the position of the pressing device.

The switching path may be set such that it remains constant, independently from the diameter of the pressure roll or the driving roll.

The pressing piston is constituted by a spring-biased pressing bar which may be actuated hydraulically, pneumatically or by a spring.

The actuating element may be shifted radially relative to the rolls.

The actuating element is longitudinally displaceable.

The actuating element is an elastic tension element.

The actuating element is a cable, a strap or the like.

The actuating element is biased, for example, by a spring.

The actuating element is fixedly held at one end thereof.

The cable is trained about a cable deflecting pulley.

The actuating element is deflected by deflecting rollers, deflecting cylinders or deflecting pins or the like.

Each piston may displace an associated shiftable deflecting element.

The excursion of the shiftable deflecting roller corresponds to the thickness of the wrapped (wound) sliver.

The actuating element is constituted by a bar, a bow, or the like.

With each shiftable deflecting roller at least one non-shiftable (that is axially fixed) deflecting roller is associated.

With each holding device for receiving the pressing mechanism two non-shiftable deflecting rollers are associated.

The shiftable deflecting roller is facing that side of the non-shiftable deflecting rollers which is oriented away from the pressure roll.

The actuating element is connected with a movable switching device.

The movable switching device has a metal surface.

The movable switching device cooperates with a stationary switching device.

The stationary switching device comprises a measuring device which is an inductive proximity switch.

On both sides of the drawing unit (that is, at opposite axial ends of the rolls of the drawing unit) a monitoring apparatus according to the invention is provided.

DESCRIPTION OF THE PREFERRED EMBODIMENTS

Figure 1:
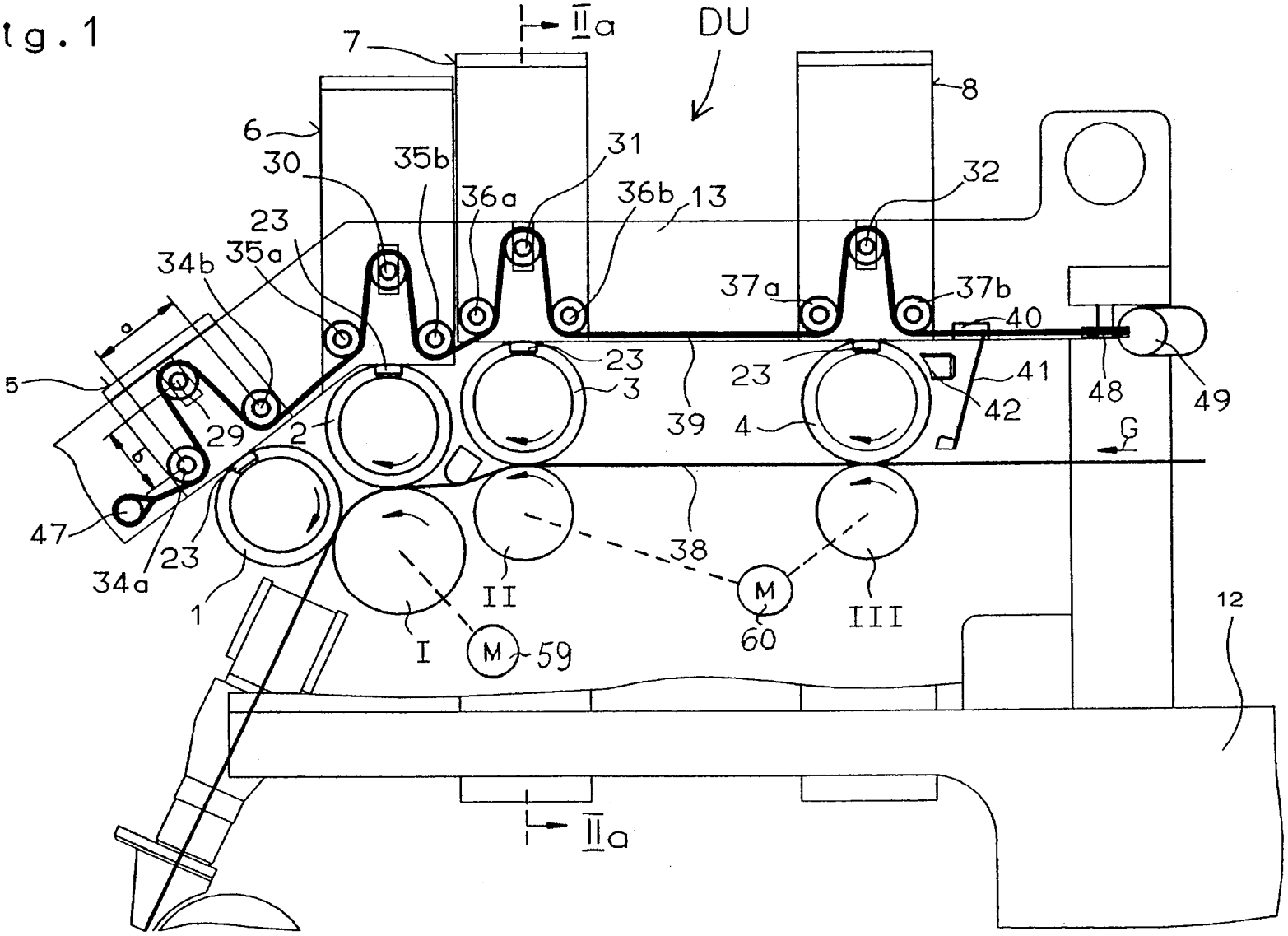
FIG. 1 is a side elevational view of a drawing unit of a drawing frame, incorporating a preferred embodiment of the invention.

Turning to FIG. 1, a 4-over-3 drawing unit DU of an otherwise not illustrated drawing frame is shown. The drawing unit is composed of three lower rolls I, II and III and four upper rolls 1, 2, 3 and 4. The roll I is the lower outlet roll, the roll II is the lower middle roll and the roll III is the lower input roll. The drawing unit DU processes the sliver 38. The draft is composed of a pre-draft and a principal draft. The roll pairs 4/III and 3/II form the pre-drafting field whereas the roll pairs 3/II and 1, 2/I form the principal drafting field.

Figure 4:
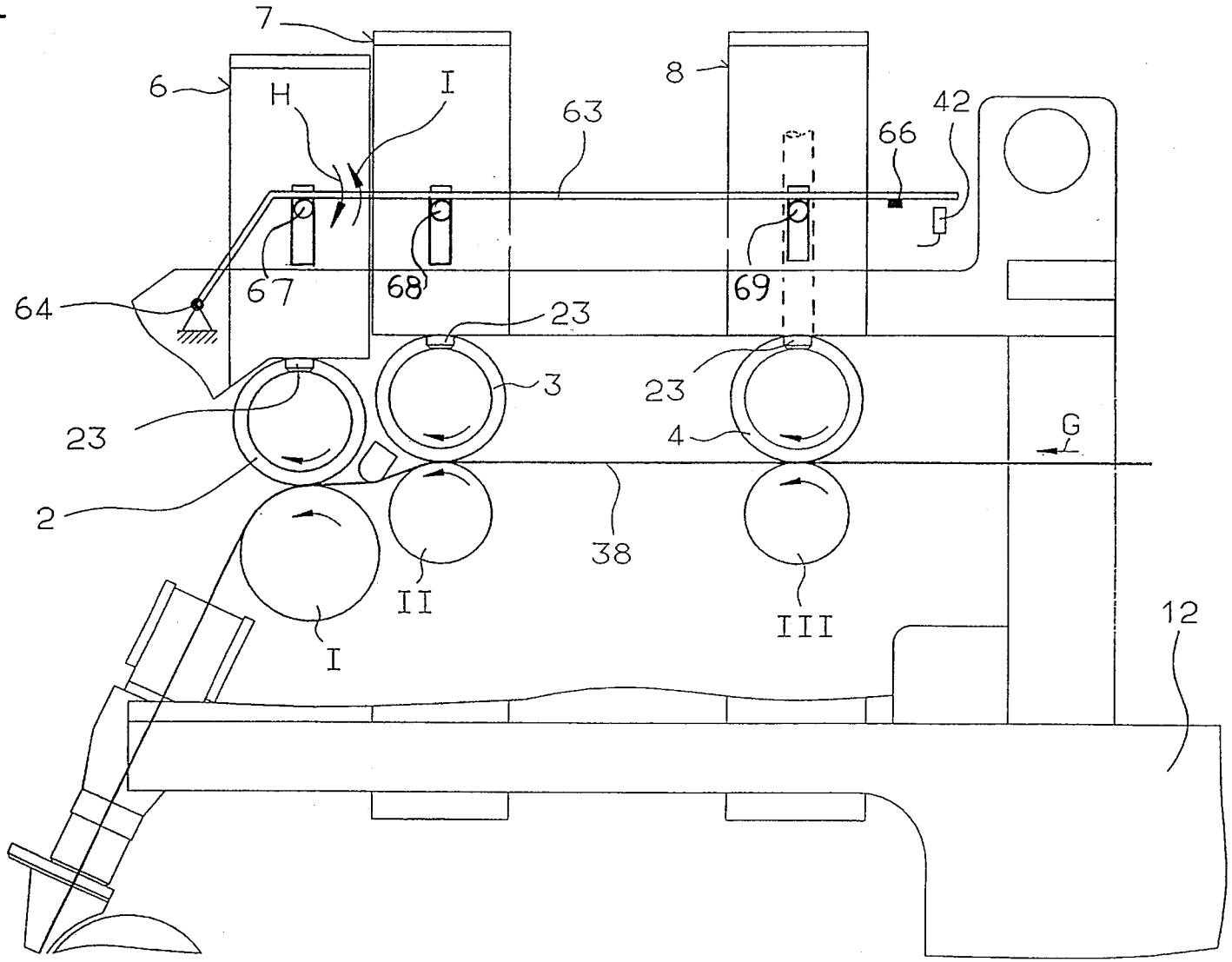
FIG. 4 is a view similar to FIG. 1, incorporating still another preferred embodiment.

The lower output roll I is driven by the principal motor 59 which thus sets the delivery speed for the drawing unit DU. The lower input and middle rolls III and II, respectively, are driven by a motor 60 and a pre-draft transmission gear. The lower rolls I, II and III can thus be designated as driving rolls. The upper rolls 1–4 are pressed against the respective lower rolls I, II, III by pressing devices 5, 6, 7 and 8 mounted in a yoke 13 which is pivotally secured to the machine frame 12 at 13*a*. The upper rolls 1–4 are thus driven by the lower rolls I-III by frictional engagement. The direction of rotation of the rolls I, II, III as well as 1, 2, 3 and 4 is shown by the arcuate arrows drawn into the respective roll. The sliver 38 which is composed of a plurality of slivers 53*a*, 53*b* and 53*c* as shown in FIG. 4, runs in the direction G. The lower rolls I, II and III are supported in bearing sleeves 11 (FIGS. 2*a* and 2*b*) mounted on the machine frame 12.

Figure 2B:
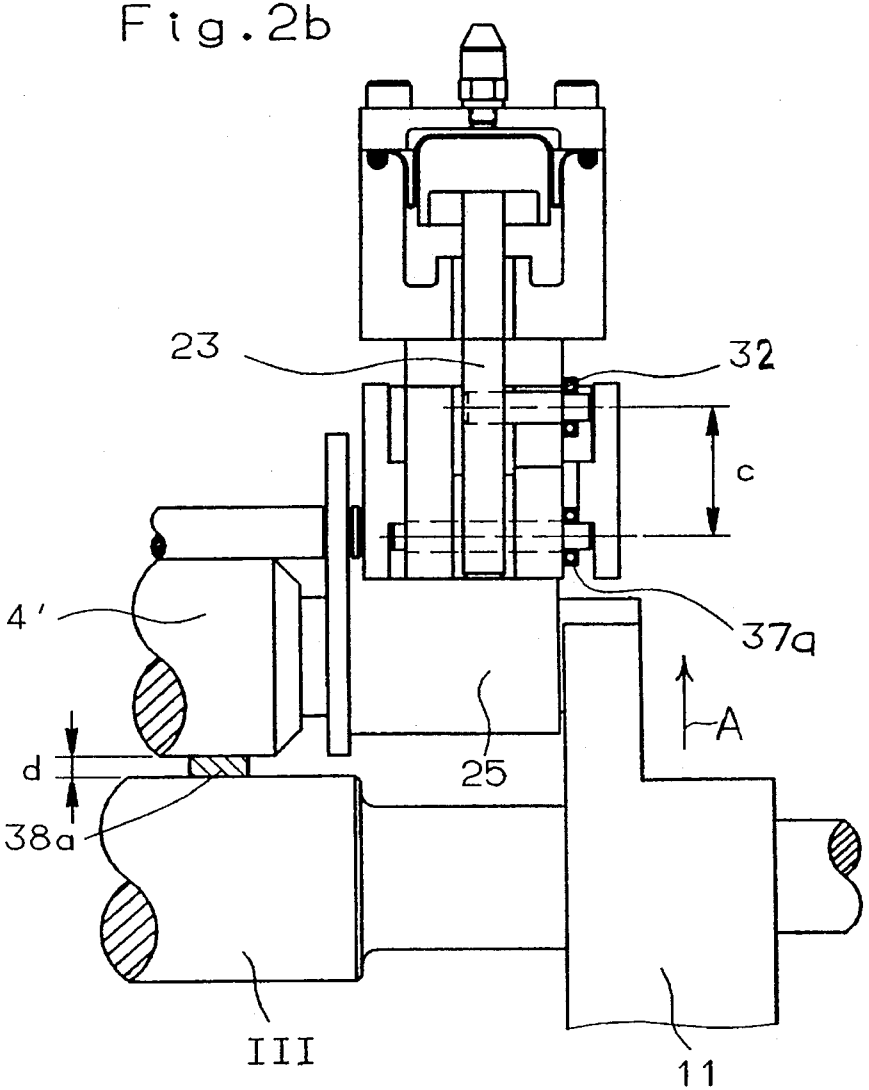
FIG. 2*b* is an illustration similar to FIG. 2*a*, showing a different operational position.
Figure 2A:
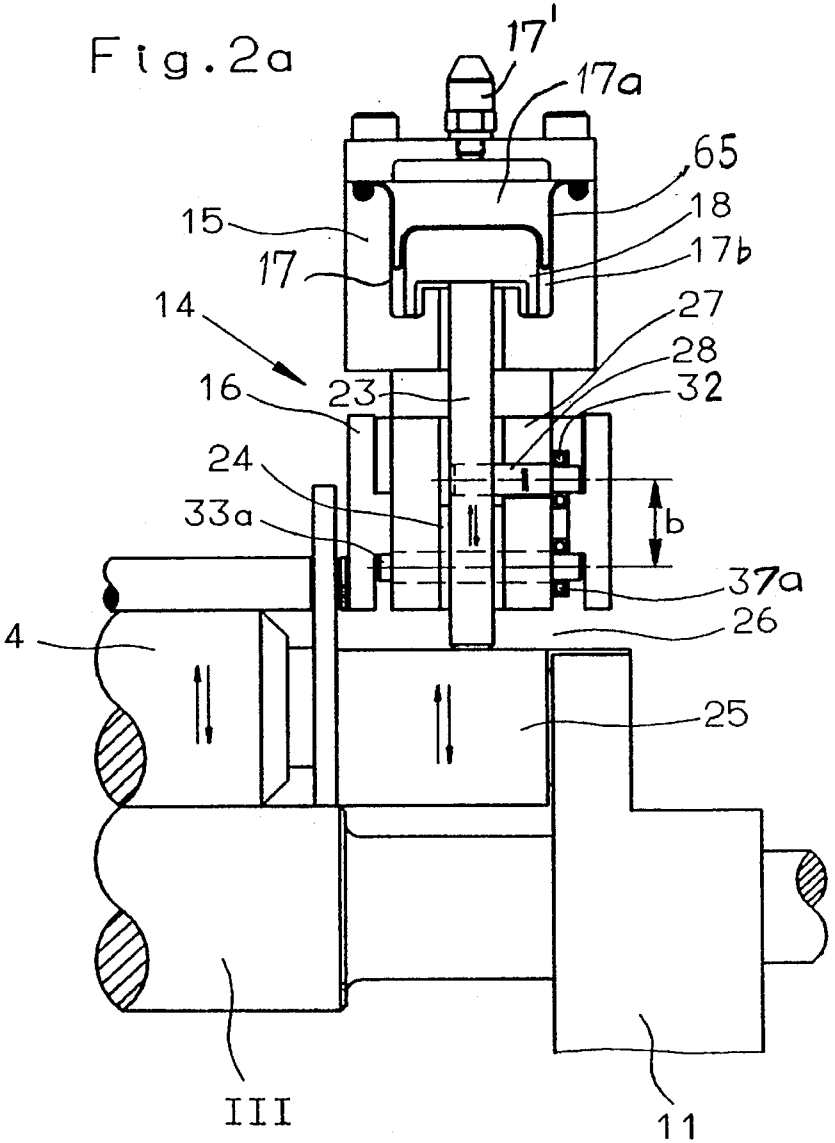
FIG. 2*a* is a sectional view taken along line II*a*—II*a* of FIG. 1.

As shown in FIGS. 2*a* and 2*b*, a pressure roll holder 14 is provided which radially displaceably (floatably) supports the pressure roll 4. It is noted that separate such pressure roll holders 14 are associated with the other pressure rolls 1–3.

Figure 1A:
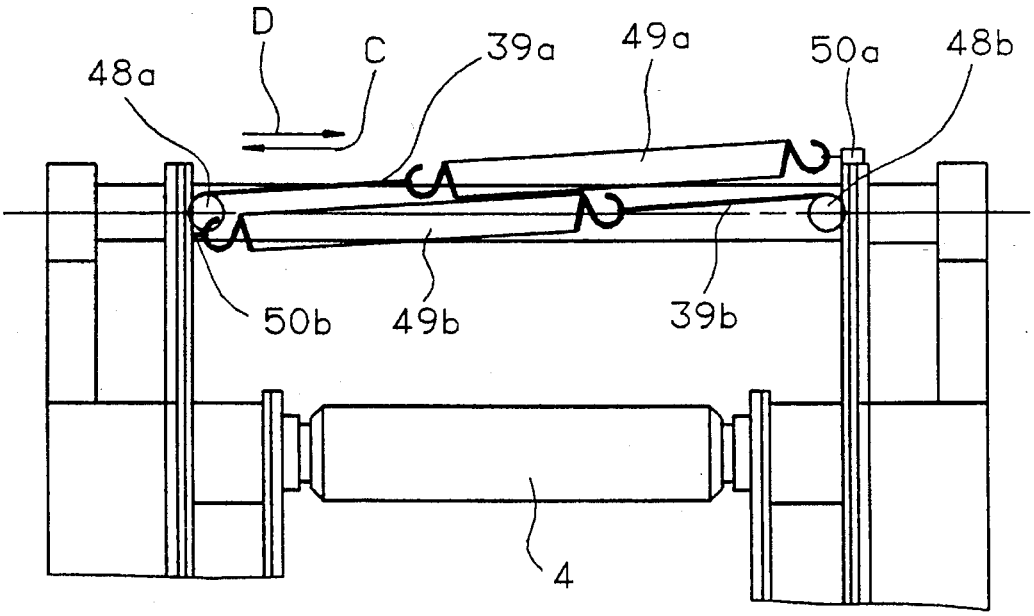
FIG. 1*a* is a top plan view of a detail of the preferred embodiment of FIG. 1.
Figure 1B:
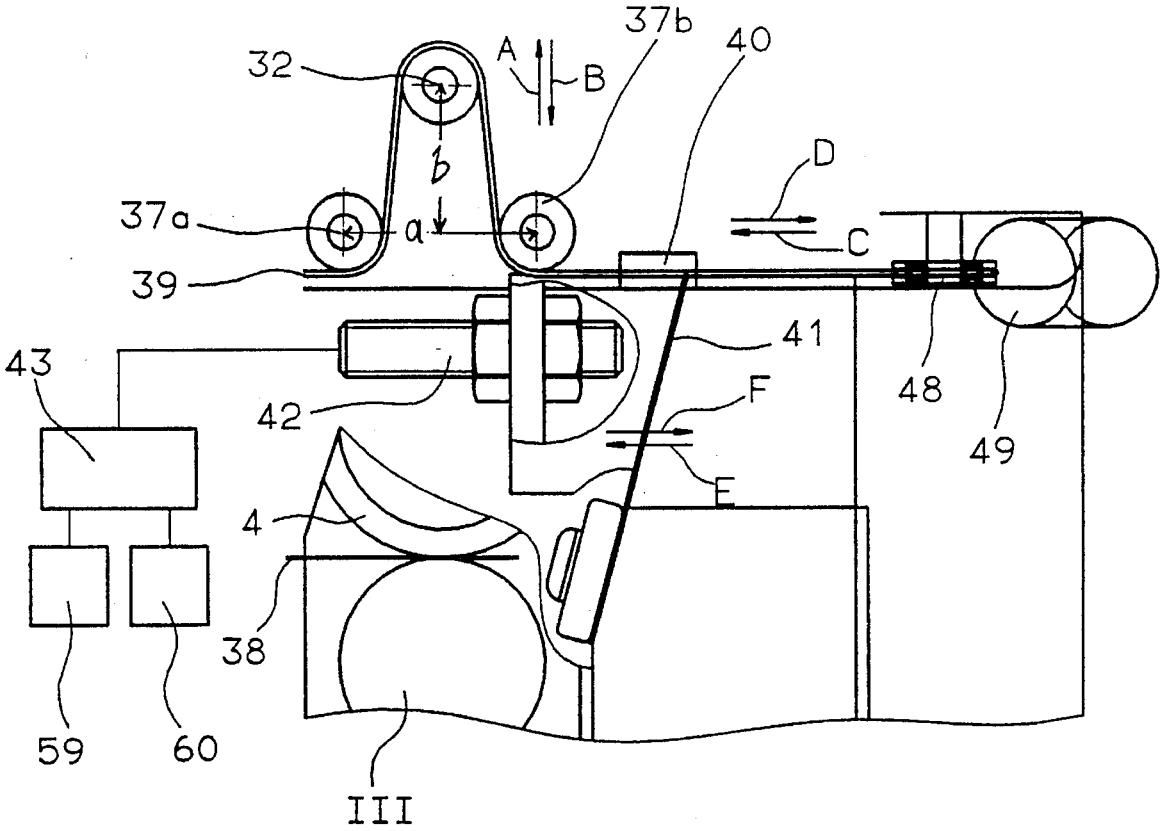
FIG. 1*b* is a side elevational view of a detail of the preferred embodiment of FIG. 1.

With particular reference to FIGS. 1*b* and 2*a*, the pressure roll holder 14 for the pressure roll 4 carries two non-shiftable deflecting rollers 37*a* and 37*b* whose rotary axis is at a distance a from one another. Similar non-shiftable deflecting rollers 34*a*, 34*b*; 35*a*, 35*b*; and 36*a*, 36*b* are associated with respective pressure rolls 1, 2 and 3.

As seen in FIGS. 1 and 2*a*, the pressure roll 4 is associated with a vertically-oriented pressing bar 23 which carries a shiftable deflecting roller 32. Similarly, the pressure rolls 1, 2 and 3 are associated with respective pressing bars 23 which, in turn, carry respective shiftable deflecting rollers 29, 30 and 31. In each instance, the distance between the line connecting the rotary axes of the two non-shiftable deflecting rollers and the rotary axis of the respective shiftable deflecting roller is designated at b.

A single cable 39 is trained consecutively about the outwardly-oriented surface of all shiftable and non-shiftable deflecting rollers in each pressure roll holder 14. The cable 39 is stationarily held at one of its ends by a securing pin 47 affixed to the pivotal yoke 13. Upstream of the roll pair III/4 as viewed in the direction of sliver run G the cable 39 is trained about a deflecting roller 48*a*. As shown in FIG. 1*a*, the other end of the cable 39 is attached to an end of a tension spring 49 whose other end is secured to a stationary support 50. Particularly referring to FIGS. 1 and 1*b*, the four displaceable pressing bars 23 are thus coupled with only a single actuating element (that is, the cable 39) which operates a switching device including a leaf spring 41 and an inductive proximity switch 42. Upon occurrence of sliver wrapping, the switching device 41 and 42 is actuated even if only a single shiftable deflecting roll undergoes excursion.

As shown in FIG. 1*a*, on each side of the drawing unit (that is, at each axial end of the rolls of the drawing unit) a monitoring device is arranged for detecting wrap formation. The cables 39*a* and 39*b* are trained about respective deflecting rollers 48*a* and 48*b*. One end of the cables 39*a* and 39*b* is secured to a respective tension spring 49*a* and 49*b* which are hooked at their other end into stationary posts 50*a* and 50*b*, respectively.

Turning to FIGS. 2*a* and 2*b*, the pressure roll holder 14 is composed of upper and lower parts 15 and 16. The upper part 15 constitutes a cylinder unit including a cylinder 17 slidably receiving a piston 18. The piston 18 is secured to the pressing bar 23 which, in turn, slides in a guide sleeve 24 provided in a sleeve body 27 situated in the lower part 16 of the pressure roll holder 14.

A bearing 25 supporting an end of the pressure roll 4 extends in an opening 26 of the pressure roll holder 14. The pressing bar 23 presses with its other end against the bearing 25 to maintain the pressure between the pressure roll and the lower driving roll III.

As shown in FIGS. 2*a* and 2*b*, a diaphragm 65 secured to the upper part 15 of the pressure roll holder 14 divides the cylinder 17 into an upper and a lower cylinder chamber 17*a* and 17*b*, respectively. To generate pressure in the upper cylinder chamber 17*a*, a nipple 17' is provided to which a non-illustrated pneumatic pressure hose is connected. The lower cylinder chamber 17*b* may be depressurized by means of a non-illustrated vent. A pin 28 extends through the sleeve body 27 and is, at one end, secured to the pressing bar 23. At its other end the pin 28 carries the shiftable deflecting roller 32. Two further pins 33*a* (only one is visible in FIGS. 2*a* and 2*b*) are secured to the sleeve body 27 and pass bilaterally therethrough. The two pins 33*a* carry, at one of their ends, the non-shiftable deflecting rollers 37*a*, 37*b* (only the roller 37*a* is visible in FIG. 2*a*, both are visible in FIG. 1). The pins 28 and 33*a* extend parallel to the axes of rolls 4, III. The distance between a line connecting the axes of the non-shiftable deflecting rollers 37*a* and 37*b* and the axis of the shiftable deflecting roller is designated at b in FIGS. 1*b* and 2*a*.

In operation, after the sliver is guided over the lower rolls I, II and III, the pivotal yoke 13 is swung into its working position illustrated in FIG. 1 and fixed in this position so that the pressure rolls 1, 2, 3 and 4 may press the sliver 38 against the respective lower rolls I, II and III. The pressure is obtained by the pressing bars 23 which lie on the respective bearing 25*a*–25*d* and are urged downwardly by pressurizing the respective upper cylinder chamber 17*a*.

With particular reference to FIG. 2*b*, if on the pressure roll 4 or the lower roll III a sliver winding 38*a* appears, the pressure roll 4 is, by its associated lower roll III pushed away in the direction A against the resistance of the pressing bar 23 into the position 4' so that the bearing 25 too, and therefore also the pressing bar 23 are displaced in the direction A. As a result, at the same time, the shiftable deflecting roller 32 carried by the pin 28 is displaced in the direction A. The distance b (FIG. 2*a*) is increased to the distance c (FIG. 2*b*). It is to be understood that this sequence of events also takes place in the respective other pressure roll holders 14 in case sliver winding on any other pressure roll or lower roll takes place. As shown in FIG. 1*b*, the distance increase from to causes the cable 39 and the carrier 40 secured to the cable 39 to be pulled in the direction C. This causes the leaf spring 1 which, at one of its ends is affixed to the carrier 40, to be shifted in the direction E. As a result, the metallic surface of the leaf spring 41 approaches the inductive proximity switch 42 so that a switching action takes place whereby a control unit 43 causes an immediate interruption of the drive (drive motors 59, 60) of the drawing frame. The difference between the distances c and b corresponds to the thickness d of the winding 38*a* generated on the roll.

If for operational reasons the cylindrical working face of some or all of the pressure rolls 1–4 has to be ground, the diameter of such pressure roll is reduced. Thus, the piston 18 and therefore also the pressing bar 23 are shifted upon pressure against the bearing 25 automatically by an amount which equals half the diametrical difference. Upon such a follow-up shift automatically the position of the shiftable deflecting roll 31 is displaced by the same amount.

Figure 3A:
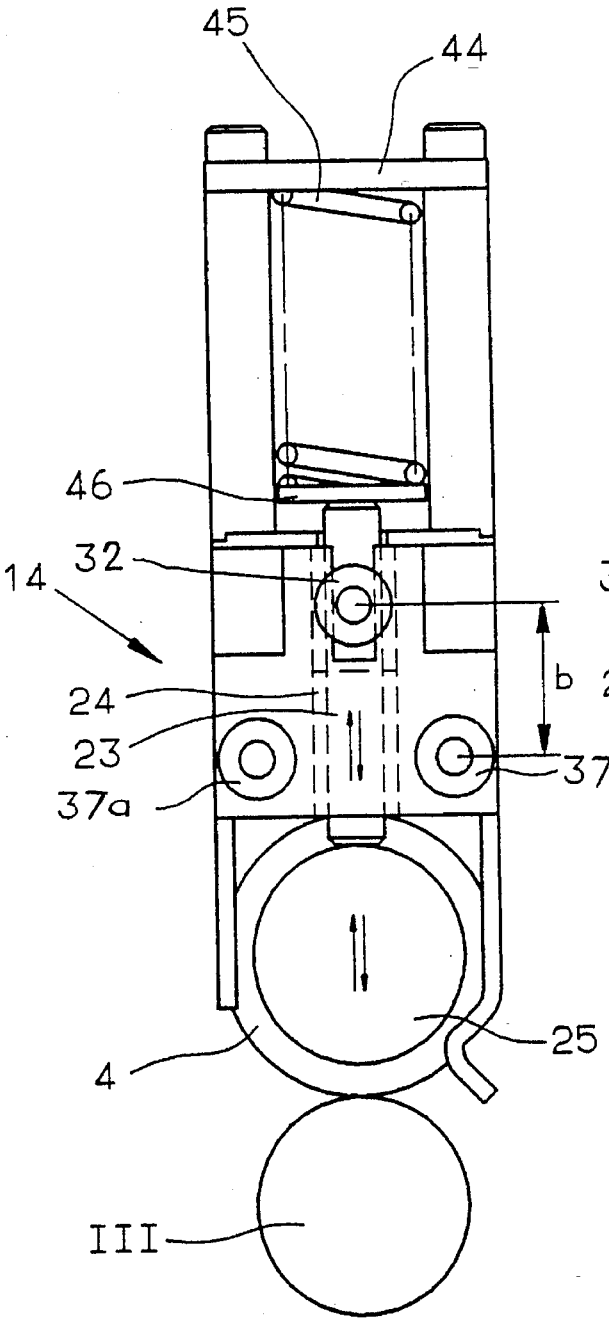
FIG. 3*a* is a side elevational detail of another preferred embodiment.
Figure 3B:
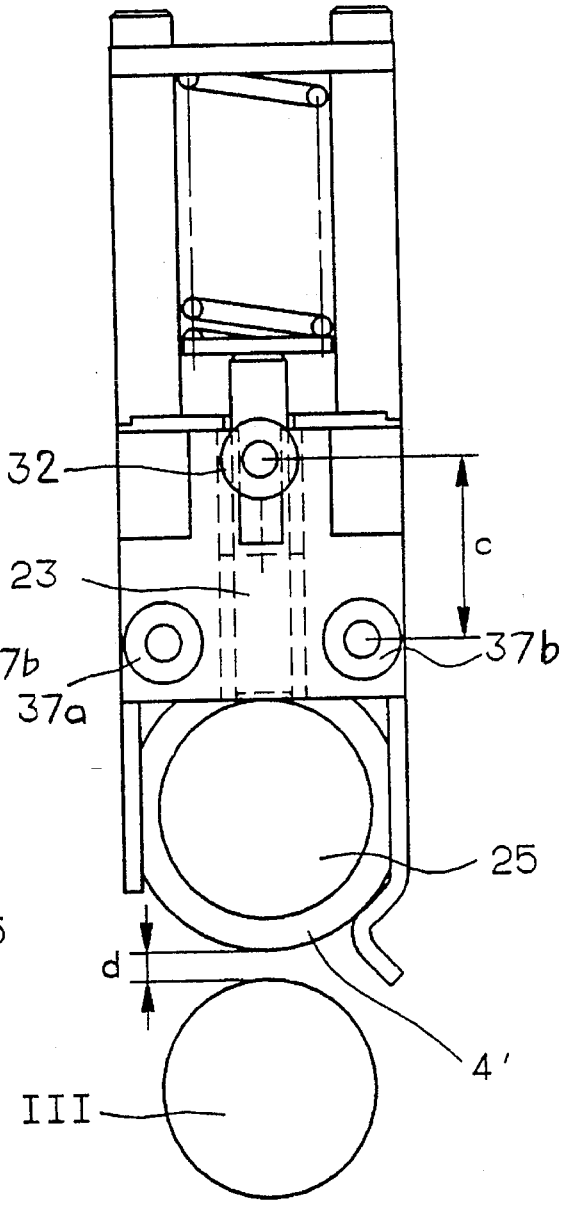
FIG. 3*b* is as view similar to FIG. 3*a*, showing a different operational position.

FIGS. 3*a* and 3*b* illustrate a mechanical solution by means of which essentially the same functions as those described in connection with FIGS. 2*a* and 2*b* may be performed. In order to exert pressure on the pressure roll bearing 25 a pressing bar 23 is provided in a bearing sleeve 24 of the pressure roll holder 14. Between a fixed end plate 44 and a movable plate 46 a compression spring 45 is disposed which, via the plate 46 exerts pressure on the upper end of the pressing bar 23. The plate (intermediate member) 46 prevents direct contact of the compression spring 45 with the pressing bar 23.

Figure 4A:
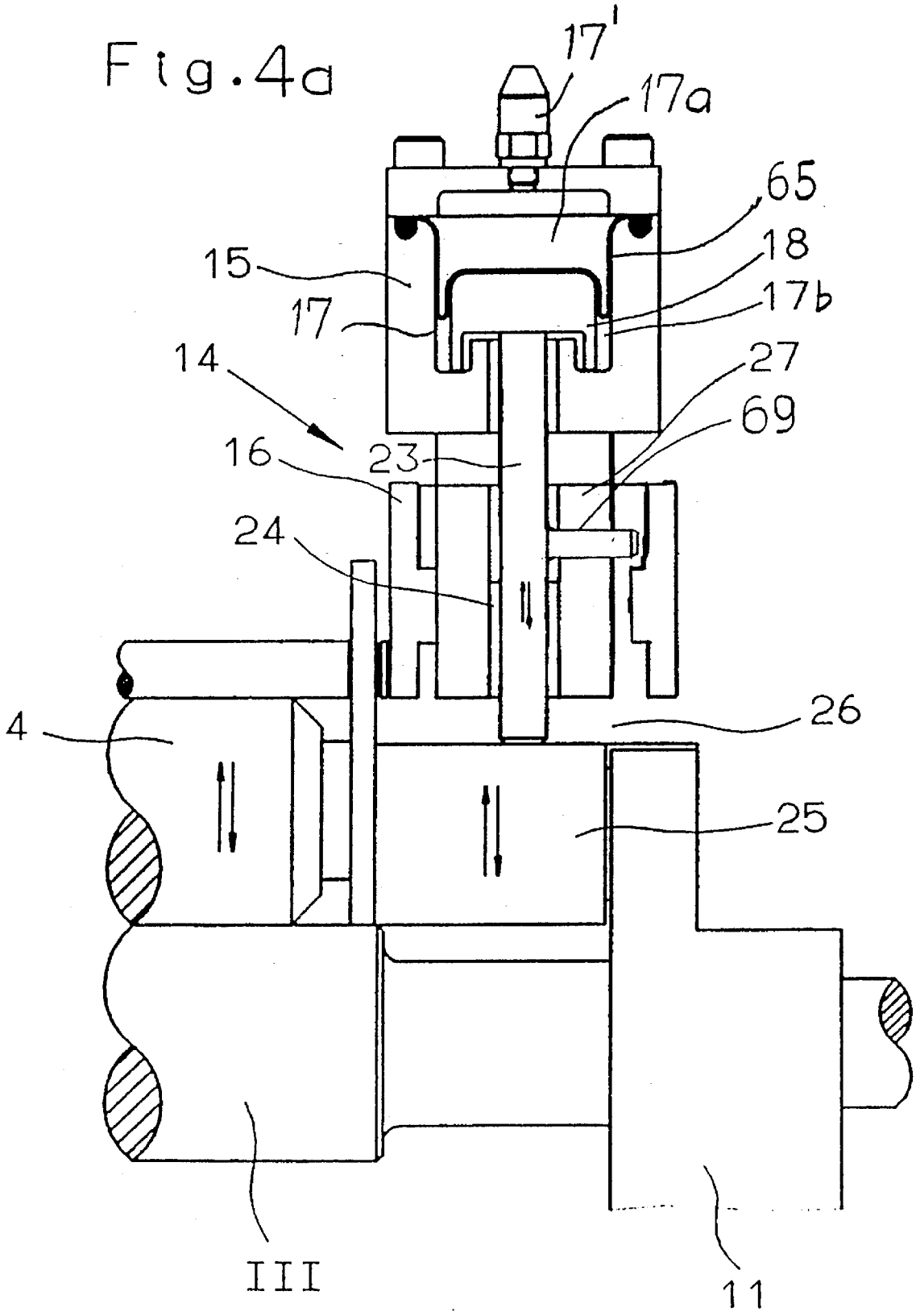
FIG. 4*a* is a view similar to FIG. 2*a*, showing the modification according to FIG. 4.

In the embodiment according to FIGS. 4 and 4*a*, the single actuating element is constituted by a substantially rigid actuating component, referred to as an actuating bar 63 which is, at its one end, pivotally secured to a machine frame component at 64. The bar 63, similarly to the cable 39 of the earlier-described embodiment, is displaced upon movement of any one of the pressing bars 23. For this purpose the actuating bar 63 extends in the vicinity of each pressing bar 23 associated with a respective pressure roll 2, 3 or 4. A stop 66 situated preferably close to the free end of the bar 63, remote from the pivot 64, is carried by a machine component and determines the position of rest (non-actuated position) of the bar 63.

As a part of the pressing bars 23, respective extensions such as lugs or pins 67, 68 and 69 are affixed to the pressing bar body and are so positioned that their path of movement is traversed by the actuating bar 63. In FIG. 4, a substantial length portion of the pressing bar 23 associated with the pressure roll 4 is shown in dotted lines to illustrate that it carries the pin 69. Stated differently, the pins 67, 68 and 69 replace the shiftable deflecting rollers 29, 30 and 31 of the embodiment described in connection with FIG. 1 and thus the pins 67, 68 and 69 are affixed to the respective pressing bars 23 similarly to the roller shaft (pin) 28 illustrated in FIG. 2*a*. FIG. 4*a* shows such an arrangement for the pressure roll holder 14 associated with the pressure roll 4. The free end of the bar 63 remote from its pivotal end cooperates with a proximity switch 42 which responds to a change in distance from the bar 63, just as the proximity switch 42 of FIGS. 1 and 1*b* responds to a change in distance from the component 41.

As any one of the pressing bars 23 is lifted by the respective pressure roll 2, 3 or 4 because winding of the sliver about a roll occurs, the respective pins 67, 68 or 69 will displace the bar 63, whereupon the proximity switch 42 will respond.

It is to be added that apart from the different actuating element (bar 63 instead of flexible belt 39) and its displacement mechanism (pins 67, 68 and 69 instead of shiftable rollers 30, 31 and 32) the operating mechanisms, for example, the pressure generator for the pressing bars 23 is the same as in the embodiment described in connection with FIG. 1.

It is well known that during normal, proper operation of the drawing frame, thickness variations in the running sliver may occur and such variations may cause radial excursions of the pressure rolls 1–4 and thus longitudinal, upward displacements of the pressing bars 23. It is apparent that such displacements should not give rise to a signal which is to represent the undesired sliver winding. Such an operation may be ensured, for example, by an appropriate setting of the sensitivity of the respective pressure sensor 42 which then would ignore displacements of the respective pressing bars 23 caused by thickness fluctuations of the running sliver. Or, particularly in the FIG. 4 embodiment, the position of the stop 66 which determines a position of rest of the non-actuated bar 63 may be made adjustable so that a positional change of the bar 63 does not occur during those displacements of the pins 67, 68, 69 which are part of the normal sliver treating operation.

Figure 5:
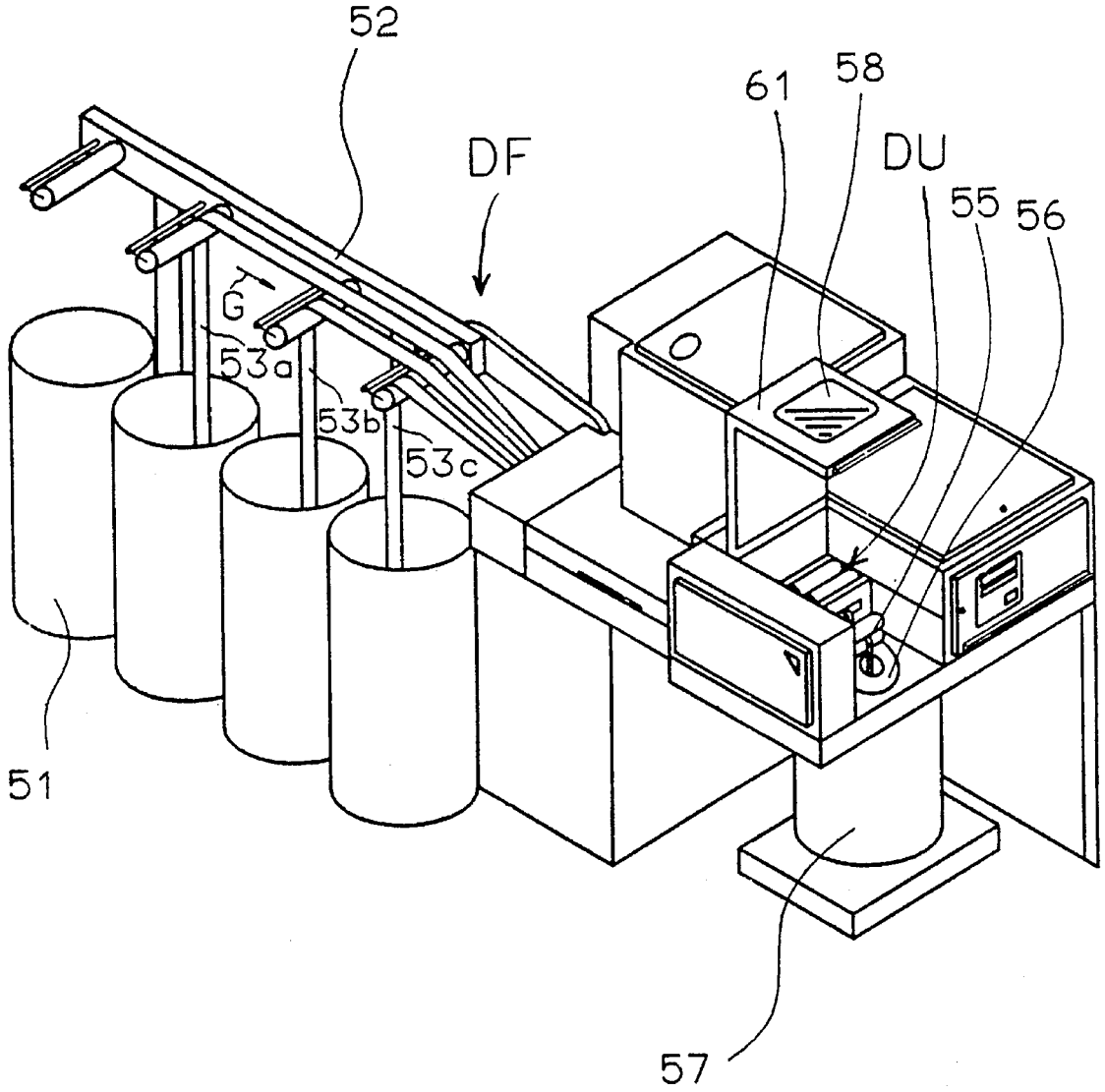
FIG. 5 is a perspective view of a drawing frame, including a drawing unit incorporating the invention.

FIG. 5 illustrates a drawing frame DF which may incorporate the invention. The drawing frame DF may be an HS Model high production machine manufactured by Tr ützschler GmbH & Co. KG, Mönchengladbach, Germany. Underneath the sliver inlet 52 of the drawing frame DF a plurality of cylindrical coiler cans 51 are arranged and the input sliver 53*a*, 53*b* and 53*c* is drawn therefrom by rollers and introduced into the drawing unit DU. After passing the drawing unit DU, the drafted sliver 55 is deposited into a coiler can 57 by means of a rotary coiler head 56. The drawing unit DU and the coiler head 56 are protected by a drawing unit cover 61 provided with a window 58 for observing the sliver drafting and sliver depositing processes.

It will be understood that the above description of the present invention is susceptible to various modifications, changes and adaptations, and the same are intended to be comprehended within the meaning and range of equivalents of the appended claims.

What is claimed is:

1. A sliver processing machine comprising (a) a plurality of roll pairs between which a running sliver passes; each roll pair being composed of a driving roll and a pressure roll;

(b) roll-supporting means for supporting each roll of each roll pair; said roll-supporting means including means for radially displaceably supporting each said pressure roll relative to the driving roll of the respective roll pair;

(c) a separate pressing device connected with each said pressure roll for urging each said pressure roll against the driving roll of the respective roll pair; each pressing device having a shiftable element displaced by the pressure roll of a respective said roll pair upon radial displacement of the pressure roll in response to winding of sliver on either the pressure roll or the driving roll of the respective roll pair; each said pressing device including (1) a pressing element contacting the pressure roll of the respective roll pair;

(2) force-generating means connected with said pressing element for urging said pressing element against the pressure roll of the respective roll pair; and (3) means for displaceably supporting said pressing element;

(4) a deflecting roller mounted on said pressing element for movement with said deflecting roller; said deflecting roller and said pressing element together forming said shiftable element;

(d) a common actuating element formed by an elongated flexible member having first and second ends and being trained about the deflecting roller of each said pressing device for displacing said common actuating element upon displacement of any one of said shiftable elements;

(e) means for fixedly holding said first end of said flexible elongated member;

(f) means for resiliently yieldably holding said second end of said flexible elongated member, said second end being displaceable longitudinally of said flexible elongated member upon displacement of any of said deflecting rollers; and (g) a switching device connected to said common actuating element; said switching device having an idle state and a signal-generating state; said switching device being placed into the signal-generating state by said common actuating element upon displacement of said common actuating element by one of said shiftable elements, whereby said switching device generates a signal in response to winding of sliver on any roll of any of said roll pairs.

2. A sliver processing machine comprising (a) a plurality of roll pairs between which a running sliver passes; each roll pair being composed of a driving roll and a pressure roll;

(b) roll-supporting means for supporting each roll of each roll pair; said roll-supporting means including means for radially displaceably supporting each said pressure roll relative to the driving roll of the respective roll pair;

(c) a separate pressing device connected with each said pressure roll for urging each said pressure roll against the driving roll of the respective roll pair; each pressing device having a shiftable element displaced by the pressure roll of a respective said roll pair upon radial displacement of the pressure roll in response to winding of sliver on either the pressure roll or the driving roll of the respective roll pair; each said pressing device including (1) a pressing element contacting the pressure roll of the respective roll pair;

(2) force-generating means connected with said pressing element for urging said pressing element against the pressure roll of the respective roll pair; and (3) means for displaceably supporting said pressing element;

(4) a deflecting roller mounted on said pressing element for movement with said deflecting roller; said deflecting roller and said pressing element together forming said shiftable element;

(d) a common actuating element formed by an elongated flexible member trained about the deflecting roller of each said pressing device for displacing said common actuating element upon displacement of any one of said shiftable elements; said elongated flexible member being selected from the group consisting of a cable, a rope and a strap; and (e) a switching device connected to said common actuating element; said switching device having an idle state and a signal-generating state; said switching device being placed into the signal-generating state by said common actuating element upon displacement of said common actuating element by one of said shiftable elements, whereby said switching device generates a signal in response to winding of sliver on any roll of any of said roll pairs.

3. A sliver processing machine comprising (a) a plurality of roll pairs between which a running sliver passes; each roll pair being composed of a driving roll and a pressure roll;

(b) roll-supporting means for supporting each roll of each roll pair; said roll-supporting means including means for radially displaceably supporting each said pressure roll relative to the driving roll of the respective roll pair;

(c) a separate pressing device connected with each said pressure roll for urging each said pressure roll against the driving roll of the respective roll pair; each pressing device having a shiftable element displaced by the pressure roll of a respective said roll pair upon radial displacement of the pressure roll in response to winding of sliver on either the pressure roll or the driving roll of the respective roll pair; each said pressing device including (1) a pressing element contacting the pressure roll of the respective roll pair;

(2) force-generating means connected with said pressing element for urging said pressing element against the pressure roll of the respective roll pair; and (3) means for displaceably supporting said pressing element;

(4) a first deflecting roller mounted on said pressing element for movement with said first deflecting roller; said first deflecting roller and said pressing element together forming said shiftable element;

(5) at least one second deflecting roller;

(6) means for radially fixedly supporting said second deflecting roller; between any two consecutive first deflecting rollers of adjoining pressing devices there being disposed at least one second deflecting roller;

(d) a common actuating element formed by an elongated flexible member trained about the first deflecting roller of each said pressing device for displacing said common actuating element upon displacement of any one of said shiftable elements; said elongated flexible member being trained about each second deflecting roller of each said pressing device; and (e) a switching device connected to said common actuating element; said switching device having an idle state and a signal-generating state; said switching device being placed into the signal-generating state by said common actuating element upon displacement of said common actuating element by one of said shiftable elements, whereby said switching device generates a signal in response to winding of sliver on any roll of any of said roll pairs.

4. The sliver processing machine as defined in claim 3, wherein each said pressing device includes two second deflecting rollers and further wherein the distance of a line connecting rotary axes of the two second deflecting rollers from a rotary axis of said first deflecting roller increases upon displacement of said first detecting roller in response to sliver winding.

5. A sliver processing machine comprising (a) a plurality of roll pairs between which a running sliver passes; each roll pair being composed of a driving roll and a pressure roll;

(b) roll-supporting means for supporting each roll of each roll pair; said roll-supporting means including means for radially displaceably supporting each said pressure roll relative to the driving roll of the respective roll pair;

(c) a separate pressing device connected with each said pressure roll for urging each said pressure roll against the driving roll of the respective roll pair; each pressing device having a shiftable element displaced by the pressure roll of a respective said roll pair upon radial displacement of the pressure roll in response to winding of sliver on either the pressure roll or the driving roll of the respective roll pair; each said pressing device including (1) a pressing element contacting the pressure roll of the respective roll pair; said pressing element being comprised in said shiftable element;

(2) force-generating means connected with said pressing element for urging said pressing element against the pressure roll of the respective roll pair; and (3) means for displaceably supporting said pressing element;

(d) a common actuating element connected to each said shiftable element of each said pressing device for displacing said common actuating element upon displacement of any one of said shiftable elements; and (e) a switching device connected to said common actuating element; said switching device having an idle state and a signal-generating state; said switching device comprising an inductive proximity switch and a trigger member carried by said common actuating element for being moved thereby relative to said proximity switch; said trigger member having a metal part; said switching device being placed into the signal-generating state by said trigger member when said trigger member reaches a predetermined position relative to said proximity switch upon displacement of said common actuating element by one of said shiftable elements, whereby said switching device generates a signal in response to winding of sliver on any roll of any of said roll pairs.

6. A sliver processing machine comprising (a) a plurality of roll pairs between which a running sliver passes; each roll pair being composed of a driving roll and a pressure roll;

(b) roll-supporting means for supporting each roll of each roll pair; said roll-supporting means including means for radially displaceably supporting each said pressure roll relative to the driving roll of the respective roll pair;

(c) a separate pressing device connected with each said pressure roll for urging each said pressure roll against the driving roll of the respective roll pair; each pressing device having a shiftable element displaced by the pressure roll of a respective said roll pair upon radial displacement of the pressure roll in response to winding of sliver on either the pressure roll or the driving roll of the respective roll pair; each said pressing device including (1) a pressing element contacting the pressure roll of the respective roll pair; said pressing element being comprised in said shiftable element;

(2) force-generating means connected with said pressing element for urging said pressing element against the pressure roll of the respective roll pair; and (3) means for displaceably supporting said pressing element;

(d) a common actuating element formed of a flexible elongated member connected to each said shiftable element of each said pressing device for displacing said common actuating element upon displacement of any one of said shiftable elements; and (e) a switching device connected to said common actuating element; said switching device having an idle state and a signal-generating state; said switching device comprising a proximity switch and a trigger member carried by said common actuating element for being moved thereby relative to said proximity switch; said switching device being placed into the signal-generating state by said trigger member when said trigger member reaches a predetermined position relative to said proximity switch upon displacement of said common actuating element by one of said shiftable elements, whereby said switching device generates a signal in response to winding of sliver on any roll of any of said roll pairs.

7. A sliver processing machine comprising (a) a plurality of roll pairs between which a running sliver passes; each roll pair being composed of a driving roll and a pressure roll;

(b) roll-supporting means for supporting each roll of each roll pair; said roll-supporting means including means for radially displaceably supporting each said pressure roll relative to the driving roll of the respective roll pair;

(c) a separate pressing device connected with each said pressure roll for urging each said pressure roll against the driving roll of the respective roll pair; each pressing device having a shiftable element displaced by the pressure roll of a respective said roll pair upon radial displacement of the pressure roll in response to winding of sliver on either the pressure roll or the driving roll of the respective roll pair; each said pressing device including (1) a pressing element contacting the pressure roll of the respective roll pair; said pressing element being comprised in said shiftable element;

(2) force-generating means connected with said pressing element for urging said pressing element against the pressure roll of the respective roll pair; and (3) means for displaceably supporting said pressing element;

(d) a common actuating element formed of an actuating bar and being connected to each said shiftable element of each said pressing device for displacing said common actuating element upon displacement of any one of said shiftable elements;

(e) means for supporting said actuating bar at least at one location thereof; said actuating bar being displaceable by any of said shiftable elements; and (f) a switching device connected to said common actuating element; said switching device having an idle state and a signal-generating state; said switching device comprising a proximity switch and a trigger member forming a portion of said actuating bar for moving relative to said proximity switch; said switching device being placed into the signal-generating state by said trigger member when said trigger member reaches a predetermined position relative to said proximity switch upon displacement of said actuating bar by one of said shiftable elements, whereby said switching device generates a signal in response to winding of sliver on any roll of any of said roll pairs.

8. A sliver processing machine comprising (a) a plurality of roll pairs between which a running sliver passes; each roll pair being composed of a driving roll and a pressure roll;

(b) roll-supporting means for supporting each roll of each roll pair; said roll-supporting means including means for radially displaceably supporting each said pressure roll relative to the driving roll of the respective roll pair;

(c) a separate pressing device connected with each said pressure roll for urging each said pressure roll against the driving roll of the respective roll pair; each pressing device having a shiftable element displaced by the pressure roll of a respective said roll pair upon radial displacement of the pressure roll in response to winding of sliver on either the pressure roll or the driving roll of the respective roll pair;

(d) a common actuating bar connected to each said shiftable element of each said pressing device for displacing said common actuating bar upon displacement of any one of said shiftable elements;

(e) means for pivotally supporting said actuating bar at one location thereof; said actuating bar being angularly displaceable by any of said shiftable elements; and (f) a switching device connected to said common actuating bar; said switching device having an idle state and a signal-generating state; said switching device being placed into the signal-generating state by said common actuating bar upon displacement of said common actuating bar by one of said shiftable elements, whereby said switching device generates a signal response to winding of sliver on any roll of any of said roll pairs.

9. The sliver processing machine as defined in claim 8, wherein each said pressing device includes (a) a pressing element contacting the pressure roll of the respective roll pair; said pressing element being comprised in said shiftable element;

(b) force-generating means connected with said pressing element for urging said pressing element against the pressure roll of the respective roll pair; and (c) means for displaceably supporting said pressing element.

10. The sliver processing machine as defined in claim 9, wherein said means for displaceably supporting said pressing element includes means for providing for a radial displacement of said pressing element and relative to the pressure roll of the respective roll pair.

11. The sliver processing machine as defined in claim 9, wherein said pressing element comprises a pressing bar having a first end contacting the pressure roll and a second end contacting said force-generating means.

12. The sliver processing machine as defined in claim 9, wherein said force-generating means includes a power cylinder unit composed of a cylinder, a piston slidably received in said cylinder and means for applying fluid under pressure to said cylinder; said piston being connected to said pressing element.

13. The sliver processing machine as defined in claim 9, wherein said force-generating means includes a spring.

14. The sliver processing machine as defined in claim 8, wherein said switching device comprises a proximity switch and a trigger member carried by said common actuating bar for being moved thereby relative to said proximity switch;

said proximity switch assuming said signal-generating state when said trigger member reaches a predetermined position relative to said proximity switch.

15. The sliver processing machine as defined in claim 8, further comprising an abutment positioned in a path of travel of said actuating bar for setting a position of rest for said actuating bar.

16. The sliver processing machine as defined in claim 8, wherein said location is a first location; said actuating bar having a second location; said switching device being situated at said second location.

17. The sliver processing machine as defined in claim 8, further comprising a component carried by each said shiftable element as a rigid part thereof; said component being situated in a path of travel of said actuating bar for engaging and displacing said actuating bar upon movement of a respective said shiftable element.

18. The sliver processing machine as defined in claim 17, wherein said component comprises a pin.

* * * * *